US008941498B2

(12) United States Patent
Berg

(10) Patent No.: US 8,941,498 B2
(45) Date of Patent: Jan. 27, 2015

(54) POINT OF SALE DEACTIVATION TABLET AND METHOD

(75) Inventor: John S. Berg, Franklin, MA (US)

(73) Assignee: SP Technology, Stamford, CT (US)

( * ) Notice: Subject to any disclaimer, the term of this patent is extended or adjusted under 35 U.S.C. 154(b) by 84 days.

(21) Appl. No.: 13/289,946

(22) Filed: Nov. 4, 2011

(65) Prior Publication Data

US 2012/0112912 A1 May 10, 2012

Related U.S. Application Data

(60) Provisional application No. 61/410,661, filed on Nov. 5, 2010.

(51) Int. Cl.
*G08B 13/14* (2006.01)
*G08B 13/24* (2006.01)

(52) U.S. Cl.
CPC ..... *G08B 13/2411* (2013.01)
USPC ..... 340/572.3

(58) Field of Classification Search
CPC ..... G08B 13/242; G08B 13/2411; G08B 13/2425
USPC ..... 235/454, 492; 382/103, 104, 181, 454, 382/492
See application file for complete search history.

(56) References Cited

U.S. PATENT DOCUMENTS

| | | | | |
|---|---|---|---|---|
| 7,161,489 | B2 * | 1/2007 | Sullivan et al. | 340/572.4 |
| 2004/0113791 | A1 | 6/2004 | Mohamed | |
| 2008/0303637 | A1 * | 12/2008 | Gelbman et al. | 340/10.42 |
| 2009/0051534 | A1 * | 2/2009 | Aguirre et al. | 340/572.1 |
| 2009/0090780 | A1 | 4/2009 | Clark | |
| 2009/0223260 | A1 * | 9/2009 | Conti et al. | 70/57.1 |
| 2010/0015917 | A1 * | 1/2010 | Symons et al. | 455/41.1 |
| 2010/0019904 | A1 * | 1/2010 | Hall | 340/572.1 |
| 2010/0171619 | A1 * | 7/2010 | Hall | 340/572.3 |
| 2010/0300159 | A1 * | 12/2010 | Berg et al. | 70/58 |

OTHER PUBLICATIONS

PCT/US2011/059443 Srch Rp, Apr. 24, 2012, Berg, John S.
PCT/US2011/059443 Writ Op, Apr. 24, 2012, Berg, John S.
IPR PCT/US11/059443, May 16, 2013, Berg, John S.

* cited by examiner

*Primary Examiner* — Brian Zimmerman
*Assistant Examiner* — Thomas McCormack
(74) *Attorney, Agent, or Firm* — Kelley Drye & Warren LLP

(57) ABSTRACT

A method and system for deactivating locks, locking the functionality of products and/or the product packing in which such products are sold, in particular remote-activation adhesive locks.

6 Claims, 3 Drawing Sheets

POINT OF SALE DEACTIVATION TABLET AND METHOD

PRIORITY CLAIM TO PREVIOUS PATENT APPLICATIONS

This patent application claims the benefit of U.S. Provisional Patent Application No. 61/410,661, filed 5 Nov. 2010 the entire disclosure of which is incorporated by reference in their entirety.

BACKGROUND OF THE INVENTION

1. Field of the Invention

The present invention generally relates an apparatus and method for deactivating lock devices associated with products and product packaging as a step in the process of completing the purchase of a product at a point of sale.

2. Description of the Related Art

There are deactivation pads or zones in check-out counters of almost every major retailer. The purpose of these zones is to deactivate a security tag such as the Electronic Article Surveillance (EAS) tag that is frequently placed on the packaging or fixed to merchandise. In one case, the EAS tag must be located within an alternating magnetic field to demagnetize tag. Once demagnetized, the tag is not sensed at the doorway of the retailer. In other more advanced systems, RFID tags are used. In this case the RFID tag is read and information from the tag is entered into a local or global database and frequently information is subsequently written to the RFID tag itself.

The RFID can be used in conjunction with lock devices associated with products and product packaging, as described in commonly owned, PCT/US10/3588 and databases. By interrogating the RFID, information may be obtained pertaining to the particular lock device associated with product and/or product identifier. Such product locks, as described in PCT/US10/3588, may interfere by its association, with the functionality of the product directly (by, for example, interfering with the flow of electricity between components, making the product physically unable to fit or to be used as desired, or by keeping the packaging about it fixedly closed). It is desirable to be able discern one RFID tags from a plurality of tags which may be in the area for multiple purchases or even adjacent to the one being purchased.

One embodiment of a remote-activation adhesive lock described in PCT/US10/3588 comprises a Remote-Activation Adhesive Lock comprising laminate of an adhesive material that expands upon impingement with particular energy source, bonded to a first carrier substrate that acts an energy converter. First carrier substrate may be, for example, a conductive metal sheet (such as a foil of aluminum, iron, steel, copper, gold, platinum) that conducts the energy to a surface of the adhesive material. In such Remote-Activation Adhesive Locks, exposure of first carrier substrate to an externally applied field causes the flow of electrical eddy currents. The eddy currents directly or indirectly initiate the expansion of the adhesive. The expansion of the adhesive causes delatching of a locking mechanism and motion of the conductive surfaces. Thus enabling use of the product or access through the product packaging Because of the energy that may be need to unlock a product or product packaging lock such as described in PCT/US10/3588, while the RFID may be read at a distance from the reading source, it may be necessary to have the lock in close proximity to an energy source in order to unlock the lock. In such cases, it may be desirable to have the unlocking circuitry associated with a Point of Sale (POS) counter in a specific location.

SUMMARY

POS Counter Deactivator Tablets have in the past been used to recognize EAS tags to deactivate the same such that pilfered goods leaving a store could be differentiated from those that were genuinely purchased. POS Counter Deactivator Tablets, however, for unlocking products and product packaging have not been available.

In an embodiment there is provided a POS Counter Deactivator Tablet or Pad for unlocking products and product packaging. Such Tablet/Pad allows for read of information stored on an RFID or other identity tag associated with a product or its packaging. The POS Counter Deactivator Tablet may be electronically coupled to one or more databases housing information related to the location of locks associated with particular products and/or product packaging and the unlocking signals and conditions (such as length of time) necessary for unlocking the locks.

A particularly useful POS Counter Deactivator Tablet may have associated with it a system designed to allow for quick placement of the item in a fixed position with respect to a static or dynamic structure such that any generated unlocking signal may be maximized for the unlocking of locks associated with the product and/or product packing. Such system may include light sources, such as LED lights, positioned so as to indicate generally where a product should be placed to optimize later deactivation of the locks. More fine placement of the product in respect of the Deactivator Tablet may be detected for example by circuitry designed detect conductive material associated with the lock by measuring any phase shift (due to a change in resonance) and/or amplitude in an interrogation signal.

In embodiments the system comprises a deactivation tablet or pad that includes matrix of light detectors arranged to detect the placement of a package and/or a matrix of indicator lights configured to indicate the proper placement of the package. An interrogation system may be used to query and receive identification information data from an electronic tag internally contained in the package, while a deactivation system that can deactivate the security lock, and a computer system including a database that contains the data and formulae required to identify the package, determine and indicate the package's proper placement for deactivation, and deactivate the security lock.

In embodiments, when all of the circuits are set, the Power relay to the Induction coil is activated for the defined duration. There are several checks that are made as the process is conducted. The first is to insure the product has not been deactivated before. This will prevent the target from being damaged by repeated deactivations but more importantly will prevent spoofing the system by using a legitimate previously activated product to be used to then immediately unlock an unpurchased product—i.e. piggy backing to defeat the system. The second is to validate that the target product is properly placed on the tablet to issuers that the correct amount of energy is transferred to the target to deactivate the device.

Deactivation may be validated by induction sensing when required. Induction sensing is achievable due to the output resonance circuit being affected by the introduction or removal of material that will effect the Inductance value of the drive coil. Any material that is placed near the output coil will cause a change in the resonance of the LC network which is indicative of content and location with respect to the inducing coil. Since resonance is calculated using $f=1/(2\pi LC)^{1/2}$, any change in the coil inductance, L, will change the resonant frequency, f, of the tuned circuit. By holding the drive frequency constant at a preset frequency, this will cause a change in the peak of the signal detected at the drive coil. This change will be both in a phase shift and an amplitude change. That is, the change in resonance causes a phase shift and amplitude change in the signal. Detecting this change in peak phase and amplitude can be used to determination the location of the target product and the state of the material. Phase from a generator circuit may be compared to the phase of the signal driving the induction coil, with the deviation being stored. When the target is place in the induction field, the second reading is monitored indicating the change in the signal. There is also a corresponding change in the amplitude of the signal due to the tuning and mistuning of the output drive resonant circuit.

Since this characteristic is measurable, the way that the deactivator works, is that the frequency (stored in the database) that is sent to the Induction coil is intentionally mistuned until the product is properly placed and then the peak signal will be detected. Deactivation of the target product will then cause the signal to become out of resonance.

The Validity of the product being brought into the Deactivator field preferably may be checked. The RFID information is collected and compared to the database information. The Detection Plate will signify that the Product is valid by setting up targeting lights on the plate. As the target product is brought into the correct targeting area, the low level signal that is being fed by the Induction Drive circuits will be monitored. The inductive field will be affected by the metallic content of the target product and will shift the resonance of the circuit. This signal is fed back to the electronic controller circuit and the phase shift and change in the amplitude of the signal is captured and sent back to the computer using an a nalog to digital converter through a serial communication interface. Once the information is detected, the unit may activate the High Frequency FET Driver circuit and cause the induction coil to drive the concentrated flux field directed at the target product for the defined time at a controlled frequency and power profile recovered from the product database. After the deactivation time, the unit will again feed the coil with a low level signal and capture the Phase and amplitude of the signal. This information can be used to determine if the locks associated with the product/product packaging were correctly deactivated. The Sensor plate will then display the result of the analysis.

The Flux field is produced by a drive coil mounted to the Deactivation Tablet. The coil may be constructed with a flux concentrator to direct the flux field toward the target and away from the circuits in the unit. The drive coil may be tuned using a tuning capacitor which may be programmable, and may be implemented as a switchable capacitor bank.

Sensing of product location, data acquisition from the identification tag, such as RFID tag, and control and transmission of the actual deactivation signal may be performed through a Controller Board. Controller Board may be the source of drive frequency sine waves, and through the Power Driver board may drive the Power FET Driver Circuit. The FET Driver Circuit may be designed to drive an indication resonant circuit, for example with 150VAC high frequency signal, and have a wide band frequency response. The signal generator circuit may be digitally controlled by a sine wave generator over a wide frequency range set using a digital multiplexer circuit.

In one embodiment there is disclosed a method comprising the steps of: (a) detecting the presence of an identification tag attached to a product or product packaging indicating the presence of product and/or product packaging locks or EAS tags being associated therewith; (b) interrogating said tag to determine identification data information; (c) interrogating a database to determine the protocol for unlocking by deactivation the locks associated with the product and/or product packaging; (d) providing visual indications to guide placement of product relative to a deactivation tablet; (e) determining if product is correctly placed, relative to the deactivation tablet, by means of light sensing devices; (f) radiating a deactivation signal, if product is determined to be correctly placed according to the determined protocol; and (g) detecting whether the locks are unlocked and/or EAS tags disabled by the deactivation. Such method may further comprise the step of logging the performance of each step to a data base. The method may also comprise the step of validating the presence of the product by detecting the frequency shift of the product within the field and comparing the frequency shift to a value stored in a database.

Further disclosed in embodiments is a system comprising: a reader operatively configured to detecting product identification tags encoded with information correlatable with positions of energy deactivatible locks associated with product or its product packaging; a processor operatively coupled to the reader for processing information from the product identification tags; a data storage unit operatively coupled to the processor housing a database correlating the product identification information obtained by said reader with a protocol for deactivating said locks; a energy generator operatively coupled to the processor for generating energy capable of deactivating said locks; and a confirmation unit operatively configured to confirm deactivation of the locks after energy generation by the energy generator so as to allow the product to be used without impairment, operatively coupled to the processor. The lock may comprise a Remote-Activation Adhesive Lock. The confirmation unit may measure phase lag and amplitude change in a generated field.

And yet further disclosed is an apparatus comprising: a signal generator having an input port and an output port; a transmit antenna electrically connected to said output port of said signal generator; a signal detector having an input port and output port; a receive antenna electrically connected to said input port of the electrical signal detector; a tablet comprising a plurality of light emitting devices and a plurality of light sensing devices, the light emitting devices and the light sensing devices arranged as an orthogonal grid; and a controller electrically connected to the input port of said signal generator, with output port of the signal detector, a data base system, and separately, to each of the light emitting devices and the light sensing devices. The signal generator may generate a deactivation signal or an interrogation signal in response to a command from the controller. The signal detector may receive and decode a signal in response to the interrogation signal and communicates detection to the controller. Input to the controller may comprise, in part, signals from the plurality of light sensing devices. Output from said controller may comprise, in part, drive signals to the plurality of the light emitting devices.

BRIEF DESCRIPTION OF DRAWINGS

The accompanying figures incorporated in and forming a part of the specification illustrate several aspects of embodiments of the invention and, together with the description, serve to explain the embodiments.

DETAILED DESCRIPTION OF EMBODIMENTS

Figure 1:
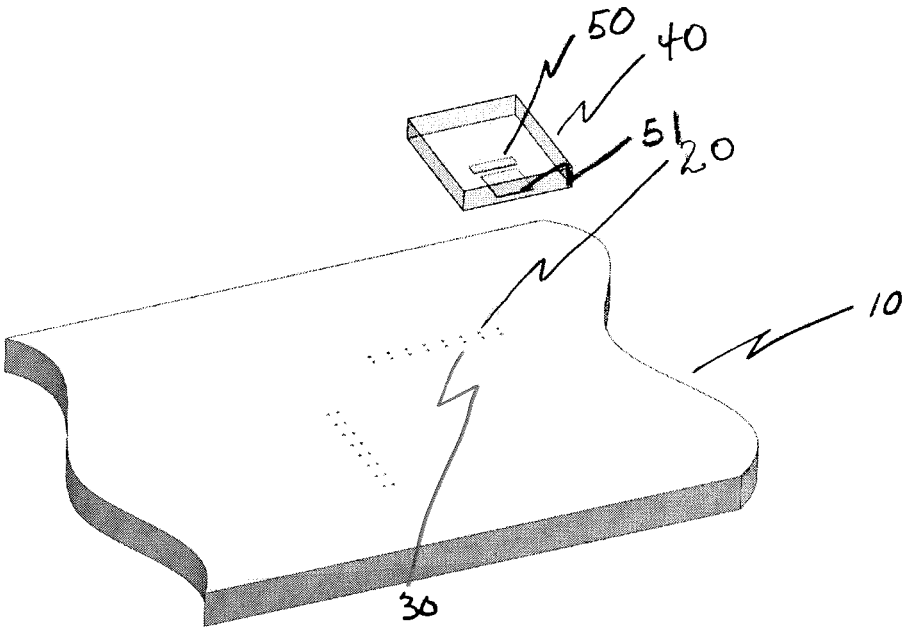
FIG. 1 is an illustration of the deactivation of a product having a lock associated therewith using an embodiment POS Counter Deactivator Tablet.

In an embodiment, shown in FIG. 1, the system creates a deactivation zone where a local field is produced within which a product 40 containing a lock 50 must be properly positioned to deactivate the lock 50. Product 40 further has associated with it an RFID or other Identity Tag 51 which allows Product 40 to be identified. The identification may be accomplished by reading data stored in the RFID tag 50 which, for example, can provide a unique serial number identification, a product code, and other data. The data read from the RFID 50 may be employed to access a remote database which returns information on placement offset location of the lock or tag with respect to the outside of the package and other relevant information. This is used to determine proper product placement on the counter to deactivate the security tag 50.

As shown in FIG. 1, in an embodiment, the countertop or deactivation tablet 10 comprises an orthogonal grid of LED (light emitting diodes) and/or photodiodes 20 useful for providing a gross area in which the product is to be placed. In its initial state, prior to the interrogation process, all of the LEDs 20 are illuminated in an amber color. In response to a successful interrogation of the package tag 50, the LEDs 20 which indicate the proper alignment of the package 40 are illuminated and are alternately flashed to command attention.

A corresponding set of photo-detectors and/or diodes 30 located on the countertop or deactivation are employed to detect the placement of the package 40. The photo-detectors 30 are polled or read until the detected light pattern indicates package 40 has been placed appropriately to conceal appropriate detectors 30 within the LED illuminated area and not those which are outside the illuminated area. When the product 40 is aligned appropriately, the operator is signaled to stop moving the package 40 by a change in color, for example, to red and alternating amber lights. Package 40 is monitored to be sure it is not moving for a set small time delay. The RFID 50 may be read again to validate that a legitimate product still there. The extent of RF coupling (low frequency or high frequency) may be measured with respect to product 40. This may be done by detecting the frequency shift of the product within the field and comparing to a value from a database for the product with the packaging. Note that the greater the coupling the greater the frequency shift of resonance for a given article. After determining, for example, the phase lag and amplitude change associated with the product on the tablet, if all of the checks pass then the product and/or product packaging locks are deactivated utilizing parameters from a look-up in the database which was returned from the initial identification of the product. That the unlocking signal has appropriately deactivated the locks may be determined by measuring the change in phase/amplitude after the deactivation and comparing to a stored parameters associated with an open lock. Once the product 40 has been successfully deactivated the lights or LEDs 20 turn green indicating the product has been released.

Successful deactivation can also be determined by measuring a change in state of the function of the RFID 50 which may have its function modified by effecting a disconnect of the antenna from the RFID 50 thus rendering it non transmitting or by removal of the package from the field. Successful deactivation may also be detected by monitoring the RF field coupling to the product. The RF field coupling is sensitive to distance, magnetic material content, and conductive material content and orientation. When a product is deactivated, the process of deactivation produces a small change in distance of the conductors from the excitation source that causes a change in the frequency of resonance indicating reduced coupling. This quantity when referenced to an expected value or minimum limit indicates a successful deactivation. The design can be made to be capable of reading both LF and UHF RFID Tags. This expands the range of products that can utilize the system.

Figure 2:
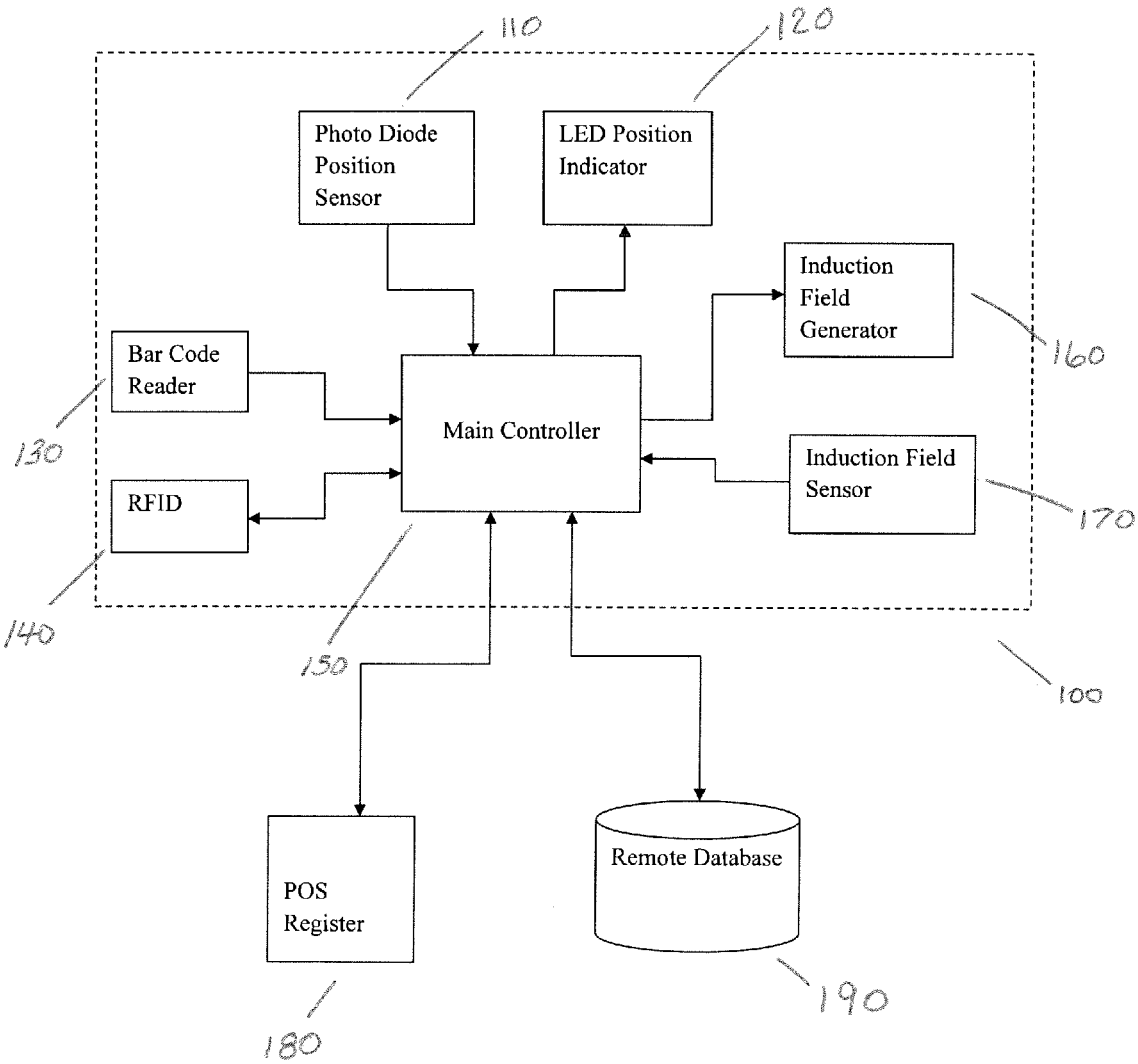
FIG. 2 is a block diagram showing an embodiment POS Counter Deactivator Tablet system.

FIG. 2 is block diagram showing an embodiment POS Counter Deactivator Tablet system. POS Counter Deactivator Tablet 125 may be controlled, for example, by Main Controller 150. Main Controller 150 activates RFID 140 and receives product identification information stored in RFID 140. It may also alternatively receive product identification information for other or alternative sources such as from bar codes encoded on the product and/or product packaging read by Bar Code Reader 130. Main Controller 150 may set LED Position Indicators 120 to provide a general guide as to position of products on the tablet, as well as set detect the position of the product on the tablet via Photo Diode Position Sensors 110. Via Induction Field Generator 160 and Induction Field Sensor 170, Main Controller 150 may be set to determine phase and amplitude changes associated with a product in the locked and unlocked state to determine from data stored in Remote Database 190 (which may in the alternative be stored proximally) whether the locks have been appropriately deactivated. Fields may be produced using a Drive Coil mounted in the LED Plate (not shown) built in a flux concentrator to direct the flux field towards the target and away from the circuits in the unit. Main Controller 150 may determine the unlocked states before POS Register 180 is activated with regard to sale of the product, or may proceed with the unlocking of the locks after POS Register 180 is activated with regard to the sale of the product.

Figure 3:
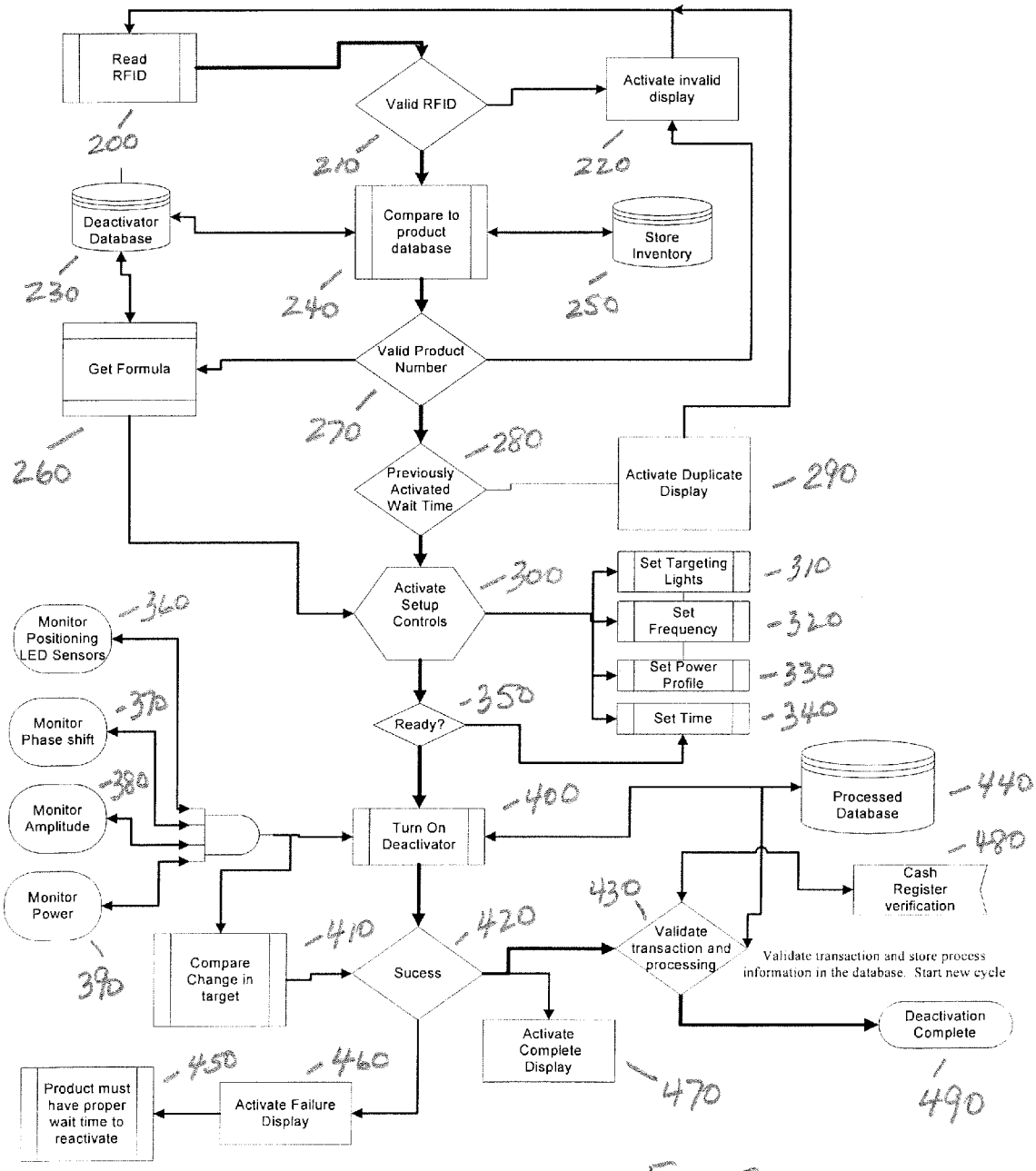
FIG. 3 is a flow diagram of a deactivator system that may be employed in the deactivation of locks associated with a product and/or product associated packaging.

FIG. 3 shows an embodiment of flow diagram for the operation of an embodiment deactivation tablet system. The operation commences when a RFID tag is read Step 200 and validated Step 210. If the RFID is invalid a warning "invalid display" Step 220 is activated. The product information available from the RFID tag is then compared to product database Step 240 to determine is the product number is valid (Step 270). If the number is not valid a warning "invalid display" Step 220 is activated. If the number is valid, then Step 260 is activated retrieving information/formulas required for setting up the lock deactivation controls (Step 300) retrieved from the Deactivator Database 230 and allowing Store Inventory 250 to be debited for the product being sold. Information/formulas may, for example, consist of the Frequency to be used in deactivation, the amplitude (Power Drive) and the duration of time that the Induction Coil will be activated during deactivation of the locks. This combination will be different for each type of deactivator device. With a valid Product number detected, the formula is pulled from the table and each of the control circuits are set up 120 by the computer. Valid product number determination also sets up retrieval of a needed wait time for deactivation of the product/product packaging locks (Step 280) unless a previous deactivation is detected which is noted at Activate Duplicate Display Step 290.

In positioning the product/product package on the tablet, the Activate Setup Control Step 300 is performed. At such control step the target lights for positioning of the product/ product packaging are set up with respect to the product (Step 310) with other Sensors being monitored to assure proper product placement (Step 360) to assure optimal deactivation of the locks. Deactivation parameters are set at Step 300, by setting Frequency (Step 320), Power Profile (Step 330) and Time Set (Step 340). Prior to and after deactivation (Step 400) the phase shift (Step 370), and amplitude (Step 380)/power (Step 390) of the field are compared (Step 410) to determine if the deactivation has appropriately unlocked the locks with deactivation information being sent to Processed Database 440. If comparison (Step 410) indicates that the delta prior to and after deactivation is within a certain range, than Success (Step 420) with the transaction being validated and processed (Step 430), the Cash Register being sent verification (step 480), and the display being set to "Activate Complete" (Step 470), and Deactivation being Completed (Step 490). On the other hand, if comparison (Step 410) is unsuccessful, the "Failure" display is activated (Step 460), and the product must be subjected to deactivation once more, after waiting an appropriate wait time to reactivate deactivation (Step 450).

STATEMENT REGARDING PREFERRED EMBODIMENTS

While the invention has been described with respect to preferred embodiments, those skilled in the art will readily appreciate that various changes and/or modifications can be made to the invention without departing from the spirit or scope of the invention as defined by the appended claims. All documents cited herein are incorporated by reference herein where appropriate for teachings of additional or alternative details, features and/or technical background.

What is claimed:

1. A method comprising:

detecting the presence of an identification tag attached to a product or product packaging indicating the presence of product locks and/or product packaging locks and/or EAS tags being associated with said locks;

interrogating said tag to determine identification data information;

interrogating a database using said identification information to determine a deactivation signal protocol for unlocking the locks and/or EAS tags associated with said product locks and/or product packaging locks;

providing visual indications to guide placement of product relative to a deactivation tablet;

determining if product is correctly placed, relative to said deactivation tablet, by means of light sensing devices;

radiating a deactivation signal, in accordance with said deactivation signal protocol, if product is determined to be correctly placed;

detecting whether said locks are unlocked and/or EAS tags associated with said locks, are disabled by said deactivation.

2. A system comprising:

at least one energy deactivatible product lock or product packaging lock or EAS tag associated with said lock;

a reader operatively configured to detecting energy deactivatible product locks or product packaging locks or EAS tags associated with said locks encoded with information correlatable with positions of said energy deactivatible locks or tags;

a processor operatively coupled to said reader for processing information from said locks or tags;

a data storage unit operatively coupled to said processor housing a database correlating the product identification information obtained by said reader with a protocol for deactivating said locks or tags;

an energy generator operatively coupled to said processor for generating energy capable of deactivating said locks or tags; and a confirmation unit operatively configured to confirm deactivation of said locks or tags after energy generation by said energy generator so as to allow said product to be used without impairment, operatively coupled to said processor.

3. The system of claim 2 wherein said lock comprises a Remote-Activation Adhesive Lock.

4. The system of claim 2 wherein the confirmation unit measures phase lag and amplitude change in a generated field.

5. The method in accordance with claim 4 further comprising logging the performance of each step to a data base.

6. The method in accordance with claim 4 further comprising validating the presence of said product by detecting the frequency shift of said product within the field and comparing said frequency shift to a value stored in a database.

* * * * *